United States Patent [19]

Scherzer

[11] 4,171,499

[45] Oct. 16, 1979

[54] ELECTRIC LAMP AND SOCKET CONSTRUCTION, PARTICULARLY INFRARED, ELONGATED, HIGH-POWER RADIATOR FOR PHOTO COPY APPARATUS, AND METHOD OF ITS MANUFACTURE

[75] Inventor: Joachim Scherzer, Bruchköbel, Fed. Rep. of Germany

[73] Assignee: Original Hanau Quarzlampen GmbH, Hanau am Main, Fed. Rep. of Germany

[21] Appl. No.: 812,796

[22] Filed: Jul. 5, 1977

[30] Foreign Application Priority Data

Aug. 4, 1976 [DE] Fed. Rep. of Germany ..... 2634980

[51] Int. Cl.[2] ..... H01J 5/48; H01J 5/50

[52] U.S. Cl. ..... 313/318; 339/144 T; 362/217; 362/225; 362/390; 362/448

[58] Field of Search ..... 362/217, 225, 448, 390; 313/318; 339/50 S, 52 R, 144 T, 145 D; 338/234, 236

[56] References Cited

U.S. PATENT DOCUMENTS

| | | | |
|---|---|---|---|
| 2,296,579 | 9/1942 | Seelen | 339/144 T X |
| 2,515,747 | 7/1950 | Vaughan | 313/318 X |
| 3,001,097 | 9/1961 | Smialek | 313/318 |
| 3,328,574 | 6/1967 | Linse et al. | 362/217 |
| 3,360,765 | 12/1967 | Strange et al. | 362/217 X |
| 3,390,373 | 6/1968 | Ruston | 362/217 X |
| 3,500,105 | 3/1970 | Westlund, Jr. et al. | 313/318 |
| 4,039,886 | 8/1977 | Scherzer | 339/145 D X |

*Primary Examiner*—Richard D. Lovering

*Attorney, Agent, or Firm*—Frishauf, Holtz, Goodman & Woodward

[57] ABSTRACT

To permit economical attachment of a socket end to the press of a lamp, the socket is made of a deformable synthetic plastic material, for example Teflon PFA, the socket having concentric cylindrical surfaces and being of cup shape, and the lamp press having rectangular cross section, the socket being heated to softening temperature and the lamp press to melting temperature of the socket material and then inserted into the cup-shaped socket to permit instantaneous melting andflowing of the socket material around the edges of the rectangular press, and thus seat the socket on the press end. The socket is preferably preheated in a metal mold block, and the press by a flame directed towards the end press of the lamp from a side remote from that of the electrical connection to the lead-through of the press.

14 Claims, 4 Drawing Figures

Fig.1
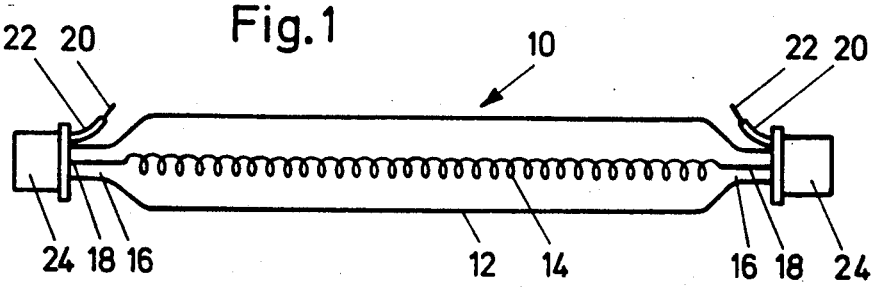
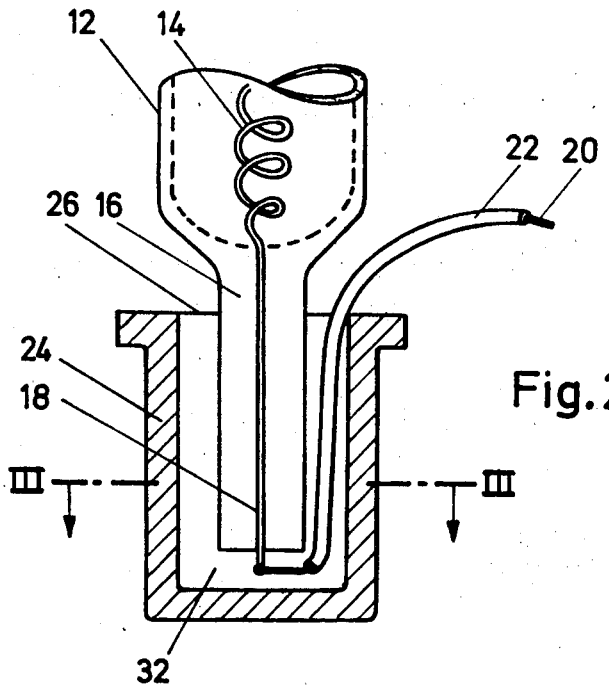
Fig.2
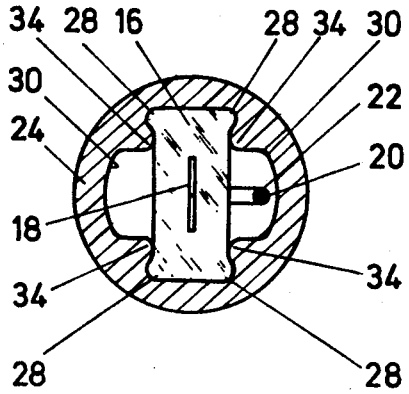
Fig.3

ELECTRIC LAMP AND SOCKET CONSTRUCTION, PARTICULARLY INFRARED, ELONGATED, HIGH-POWER RADIATOR FOR PHOTO COPY APPARATUS, AND METHOD OF ITS MANUFACTURE

The present invention relates to a lamp and socket structure, and more particularly to an elongated lamp used as an infrared and light radiation source in photo copy apparatus in which electrical conductors are carried through the lamp body at an end press, the end press portions being secured in sockets.

BACKGROUND AND PRIOR ART

Infrared (IR) and visible light radiators are used in various types of photo copy apparatus. Usually, they are formed as elongated glass cylinders with round cross section, which terminate in end press structures of generally rectangular cross section. The end press structures must be capable of holding the lamps while retaining therein electrical conductive leads capable of passing high power levels. The lamps are generally high power lamps and can be doped with halogens. The end press is made by squeezing or pressing the heated ends of the cylindrical lamp body, while including therein a thin foil of an electrically conductive material. The conductive foil extends from the end faces of the press by a certain distance in order to permit attachment of attaching pigtails or leads thereto. To insulate the the glass body and the pigtails, and to retain the lamp in customary fittings or sockets, the lamp itself is formed with matching sockets. These sockets, generally of cup-shaped construction, heretofore were made of a ceramic which surrounds the end faces of the press portions of the lamp and are attached to the adjacent portion of the cylindrical body thereof. The cylindrical outer surfaces of the sockets are secured to the glass walls of the lamp and/or of the press by means of a suitable cement. The connecting cable ends, leads or pigtails to connect current to the lamp usually are insulated by a plastic insulation tube pushed over the electrical conductor. The pigtails or leads are located in the space between the glass walls of the press and the inner walls of the sockets and then pass by the lamp to the outside for connection to a source of electric power.

It is a comparatively complex process to connect the sockets to the lamp body, requiring various working steps. First, it is necessary to place cement or other adhesive between the sockets and the press ends. Thereafter, the sockets and the press ends must be axially aligned and longitudinally measured for size, for example by placing the socket-lamp assembly, with the adhesive or cement still soft, in a gauge to determine alignment and dimension. When properly arranged, the assembly with the sockets preliminarily attached thereto must be dried or hardened to permit the cement to set, for example in a drying furnace.

THE PRESENT INVENTION

It is an object of the present invention to provide a structure, method, and apparatus to carry out the method, to attach sockets to lamps, especially to elongated lamps which have end portions of material having edges, especially rectangular cross-sectional end press portions which method is fast, efficient, and yet provides for reliable attachment of the lamp structure to the sockets and especially to the press ends thereof.

Briefly, in accordance with the present invention, the sockets are made of a material which is heat-deformable. A suitable material, for example, is Teflon PFA. The socket is heated to softening temperature, and the end press portion of the lamp is likewise heated but to a higher temperature which is still below the softening temperature of the press, however. A typical material for the press is quartz glass. If Teflon PFA is used, preheating of the socket to a temperature of about 230° to 250° C. results in sufficient softening so that, if the press is heated to a temperature of between 350° to 400° C., insertion of the heated press into the preheated socket will result in instantaneous melting of the material of the socket adjacent the point of introduction of the end press portion into the socket and, upon setting of the material of the socket, tight gripping of the socket around the end press.

The result will be a socket which is effectively secured to the end press due to the high adhesive forces between the socket and the glass wall, preventing axial shifting of the socket and the glass, as well as holding the glass end press securely with respect to relative rotation. The tight connection between the socket and the end press will remain, even upon later elevated temperatures, which may occur during operation, particularly during high-power, continuous operation.

The sockets can be made of plastic material which can readily accept high temperatures but which, when heated to yet higher levels, become softened to permit the connection between the press and the socket. The connection itself is rapidly made and will set quickly. The time necessary to cool the socket to a temperature during which further deformation is not possible is short. This short attaching time is a substantial advantage of the process, resulting in the connection as set forth. The elimination of drying ovens or furnaces substantially decreases the investment cost of the apparatus required to attach the socket to the glass press.

The contact surfaces which are formed during attachment of the socket to the glass press are sufficiently large to ensure reliable connection. An essentially rectangular press in which the longer dimension is slightly greater than the length of the corresponding chord of the undeformed socket permits flowing of the material of the socket around the glass press, while still leaving some space for the connecting pigtail between the side walls of the press and the inner wall of the socket.

The preferred material for the socket is a fluor-type synthetic material, for example Teflon PFA. This material retains its shape or form even when heated to a temperature of about 260° C. Sockets made thereof are particularly suitable for radiating-type lamps providing light rich in IR radiation of high power, in which the socket and press portions may heat during use. Teflon PFA has excellent electrical insulation properties and a small thermal coefficient of expansion. It can be plastically deformed upon heating. The sockets can be made inexpensively by injection molding.

The initial temperature to which the sockets are heated is that at which the sockets can be plastically deformed. This temperature is less than the melting temperature of the socket material. The press of the glass of the lamp itself is heated to a temperature which is higher than the melting temperature of the socket and, upon such heating, it is introduced or pushed into the socket so that the socket material will melt around the glass which, upon cooling, will grip the surrounding glass. Heating of the press as well as of the associated socket is preferably carried out simultaneously. Only few manufacturing steps are needed, which can be carried out easily and which require only little time. The socket is suitably heated to a temperature of between 230° to 250° C., whereas the press can be heated to a temperature of between 350° to 400° C. The force required to introduce the press into the socket and cause instantaneous melting upon contact of the press with the socket is low. Upon setting, the connection will be secure and permanent.

The socket is preferably heated by being introduced into a metal mold which, in turn, is heated by electrical resistance wires, steam, or the like. Simultaneously, the glass press is heated, for example by a flame applied thereto from the side remote from the connecting pigtail. This protects the insulating tube of the connecting pigtail and permits locating the socket as well as the glass bulb of the lamp, and the press, in predetermined, accurately aligned positions, for subsequent introduction of the press into the socket.

Drawings, illustrating an example:

FIG. 1 is a schematic longitudinal view of an elongated radiator providing light rich in IR radiation, particularly suitable for reproduction or copy machines;

FIG. 2 is a fragmentary longitudinal view, partly in section, and showing the socket and the end press introduced thereinto;

FIG. 3 is a cross-sectional view taken along line III—III of FIG. 2; and

Figure 4:
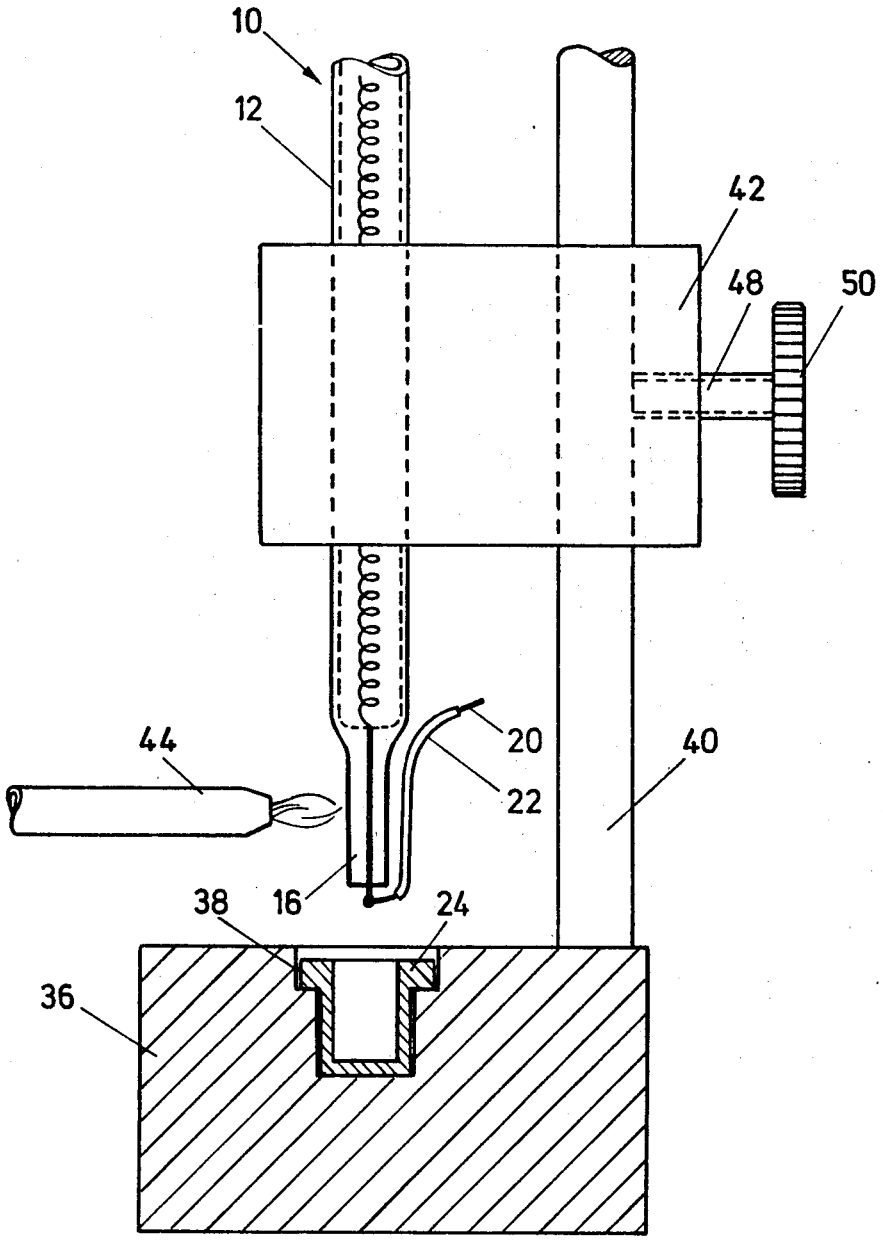
FIG. 4 is a schematic side view, partly in section, of an apparatus to connect the end press of an elongated lamp of FIG. 1 with a socket.

The radiation-emitting source 10 is an elongated body of quartz glass 12 through which a coiled filament 14 extends. The radiator 10 can be doped with halogens. The glass body 12 terminates in two end portions 16 which have generally rectangular cross section, that is, form four edges. These end portions are also referred to as end presses, formed by compressing the glass of the glass body 12. The interior of the presses 16 includes metal foils 18, which are sealed therethrough. The metal foils 18 are connected at the inside to the spiral filament 14. The externally extending portions of foils 18 are connected to connection leads or pigtails 20, formed of stranded material, insulated by insulating sleeves 22 (FIG. 2).

Sockets 24, which are cup-shaped and made of electrically insulated material, are secured to the presses at the ends 16. The socket cups 24 form insulation for the terminal portions of the sealing foils 18 extending from the respective presses 16, as well as for the free end portions of the pigtails 20, and additionally provide an attachment socket to permit placing the radiating body 10 in suitable fittings or fixtures of apparatus in which they are to be used, typically photo copy or reproduction apparatus. The pigtails 20 are bent over along the edges of the presses 16 and are placed in the interior of the sockets 24 to follow along the glass walls of the respective presses up to the openings of the sockets 24. The sockets 24 have a cylindrical outer surface and are hollow at the inside (see FIGS. 2, 3). An opening 26 is left at one end face of the sockets 24.

The sockets 24 are made of a heat deformable thermosetting material. A preferred material is a PFA fluor plastic material. These plastics are copolymers with a main structure of carbon and fluor of fluor-base plastic materials and perfluoracoxy side chains. The sockets 24 are made by injection molding, and the material retains its shape and general strength to temperatures of up to about 260° C.

The sockets 24 are formed with a cylindrical hollow inner portion. When made, that is, when originally manufactured, the diameter of the hollow cylinder is so dimensioned that it is smaller than the chord defined if the longer side of the rectangular press is placed against the end face 26 of the socket; and is larger than the respective chord of the smaller side of the rectangular cross section (see FIG. 3). The edges 28 of the press 16, and the portions which adjoin the edges 28, are pressed into the interior walls 30 of the sockets 24. This introduction of the press 16 is carried out while the socket is in plastically deformable condition, whereas the outer surface or outer wall thereof is maintained in its original cylindrical shape. The generally rectangular cross-sectional shape of the press 16 causes the formation of axially extending lateral pockets to receive the press 16, and engagement of the edges 28 as well as of the adjacent portions thereof with the inner walls of the socket 24. A space is left between the longer longitudinal wall of the press 16 and the inner wall 30 in which the pigtail 20, insulated by the insulating tube 22, can be placed—see FIGS. 2 and 3. The two sockets 24 for the radiators 10 are axially aligned for eventual placement in suitable fittings of the apparatus with which the radiator is to be used. The depth of penetration of the press 16 into the socket 24 is determined by the distance between the fittings of the apparatus. The introduction of the press 16 into the socket 24 does not extend down to the bottom thereof—see FIG. 2—but a free space 32 is left between the end surface of the press 16 and the bottom of the socket 24 through which the end of the metal foil 18 of the press can extend and to which the pigtail is secured, for example by welding.

The inner wall 30 of the socket 24 flows around the edges 28 of the press. The arrangements secures the glass tube 12 with respect to the sockets 24 against rotation and additionally provides a reliable attachment between the glass and the socket. Substantial adhesive forces arise between the edges 28 and the adjacent glass surfaces of the press 16 and the socket 24. This results in a secure seat of the sockets 24 on the end presses 16 of the glass tube 12.

The sockets 24 are slightly elastic. This improves the resistance of the sockets with respect to damage, and particularly improves the handling of the resulting assembled lamp when it is to be inserted into fittings of the apparatus with which it is to be used. Fracture of the glass tube upon handling is thus substantially reduced.

The sockets 24 can be secured to the press 16 without use of additional adhesives, cements, or other fillers. The edges 28 and the adjacent surfaces of the press 16 are introduced into the sockets 24 by pushing the edges 28 against the inner wall 30 while the socket is plastically deformable. This process can be carried out rapidly. The time saving with respect to attachment of the glass tube into sockets using cements or other adhesives or fillers is in the ratio of about 4:1.

Method of assembly, and apparatus therefor: The temperature of the press 16 of the radiator 10 is raised to above the melting temperature of the material of the sockets 24. If the sockets 24 are made of PFA-fluor plastic materials, such as Teflon PFA, the temperature is preferably in the range of from about 350° to 400° C. Simultaneously, the socket 24 is heated until the socket 24 reaches a temperature at which it can be plastically deformed, that is, for the Teflon PFA about 230° to 250°

C. As the next step, the heated press is introduced into the preheated socket, in alignment and for a predetermined depth. As the hot glass press 16 with the edges 28 touches the preheated softened socket 24, the inner wall 30 of the socket melts and the material is pushed laterally by the edges 28 of the glass press. The result will be beads 34 (FIG. 3) flowing around and increasing the area of contact between the press 16 and the socket 24. Preferably, and in the usual form, the edges 28 of the press 16 are not perfectly sharp right angle corners, but themselves are slightly rounded and formed with bead-like projections, as best seen in FIG. 3, so that the beads 34 which flow around the edges 28 will grip behind the slightly projecting end edges 28 of the press 16. No specific shape of the press is required for purposes of the present invention, so long as the press forms edged end portions (as distinguished from a smooth, round overall surface) around which the material of the socket can flow.

In the next step, the press 16 and the socket 24 are permitted to cool to room temperature. Upon cooling, the press 16 will be reliably seated in the socket 24, which will grip the glass walls of the press 16. The lamp is ready for handling when cooling of the glass press 16 has proceeded to a temperature which is below the melting temperature of the socket 24. To further decrease the time for manufacturing of the lamps, the still hot end 16 and the connected tube 24 can be removed from the attaching apparatus, the lamp reversed, and the other end of the lamp heated and the second socket applied thereto while the first end continues to cool.

The method to make the connection between the press 16 of the lamp 10 and of the socket 24, thus, requires only few and simple steps.

The apparatus to carry out the method likewise is simple and inexpensive. A heatable metal block 36 (FIG. 4) is formed with an opening 38 sized to match approximately the outer shape of the socket 24. The block 36 can be heated either by electrical resistance heating, by steam, or by any other suitable means. The socket 24 is introduced into the opening 38 and is accurately positioned thereby. The socket 24 is aligned with a holder 42 guided on a guide rod 40, secured, for example, to the metal block 36 or to another suitable portion of a holding frame (not shown) of the attachment apparatus. Guide rod 40 has a central axis which is parallel to the central axis of the socket 24 in the opening 38. The holder 42 is longitudinally movable and is arranged to clamp the glass body 12 of one of the radiator lamps 10. The attachment clamps are so arranged and aligned that the center line of the end 16 is congruent with the central axis of the socket 24 when introduced in opening 38.

A heating station for the press 16 is located above the block 36. This heating station, for example, is a burner 44 having a flame directed to the press 16 to heat the press 16 to the above referred-to temperature. The pigtail 20 is bent over to the side of the press 16 remote from the flame of the burner 44 so that the press 16 itself will form a heat shield for the insulation 22 of the pigtail 20.

When the press 16 is heated to its temperature and the socket 24 to its deformation temperature, holder 42 is moved downwardly to introduce the press 16 into the socket 24. The drive for holder 42 can be a rack-and-pinion drive, for example by engaging a rack (not shown) with a suitable gear on a shaft 48 which is manually operated by a hand wheel 50. The depth of introduction of the press 16 into the opening 38, and hence into the socket 24, it set by a suitable stop collar surrounding post 40 (not shown) or by any other suitable abutment or stop element. The distance between the end surface of the press 16 and a reference, for example the upper surface of block 36, can then be used to determine the standard depth of insertion.

The connection of the socket 24 with the press 16 is particularly suitable for combined light and IR radiators of high power which have clearly defined press ends 16 and which, in operation of the lamp, reach considerable temperatures. The connection can be used with any kind of lamps or radiating elements, for example gas discharge lamps or elements, or the like.

Various changes and modifications may be made within the scope of the inventive concept.

I claim:

1. Electric lamp structure having a glass body (12);

an end press (16) which, in cross section, has an outer circumference which is formed with edges or corners (28);

a current conductor lead (18) extending through the end press;

a connecting terminal (20) electrically and mechanically secured to the current conductor lead (18);

and a generally cup-shaped socket (24) formed with a hollow recess and with axially extending lateral pockets, wherein the socket (24) comprises a heat-deformable, thermosetting material;

the edges or corners and adjacent portions of the end press are located in the lateral pockets extending from said hollow recess;

the inner surface of the cup-shaped socket is plastically deformed and grips around at least part of the edge or corners (28) of the end press and adjacent portions while leaving a space between the edges and the inner surface (30) defining the recess of the socket, the distance of penetration of the end press (16) within the hollow recess of the cup-shaped socket being predetermined.

2. Lamp structure according to claim 1, wherein the glass body is an elongated cylinder;

the socket (24) is essentially cylindrical;

the connecting terminal (20) comprises a pigtail, located in the space between the edges (28) of the end press and the inner surface (34) of the recess of the socket (24) and wherein the central axis of the socket (24) and of the cylindrical glass body are in essentially axial alignment.

3. Lamp structure according to claim 1, wherein the cross section of the press is essentially rectangular to provide four edges, the socket (24) is essentially cylindrical and, when in undeformed condition, has essentially cylindrical inner surfaces (30), the longer sides of the rectangular press being longer, when in undeformed condition, than the corresponding inner chord dimension of the socket, and the shorter sides of the rectangular cross section of the press being less than the corresponding dimension of the socket.

4. Lamp structure according to claim 3, wherein the socket (24) comprises a plastic material which is form-stable up to a temperature of about 260° C.

5. Lamp structure according to claim 4, wherein the socket (24) comprises a PFA-fluor-carbon-type plastic material.

6. Lamp structure according to claim 4, wherein the socket comprises an injection-molded element.

7. In the production of an electric lamp structure having a glass body (12) having an end press (16) which, in cross section, has an outer surface which is formed with edges (28), an electrical current lead (18) extending through the end press, and electrical connection means (20) electrically and mechanically secured to the current conductor lead (18);

and a generally cup-shaped socket (24) formed with a hollow recess therein surrounding the end press (16) to locate the end press in the recess thereof, the method to effect connection between the glass body and the socket comprising the steps of providing a socket (24) of heat-deformable thermosetting material;

heating the socket (24) to a temperature at which the socket becomes plastically deformable, but which is below the melting temperature of the socket;

heating the end press (16) of the glass body (12) to a temperature which is above the melting temperature of the socket (24);

introducing the so heated end press (16) into the socket (24) while deforming the inner surfaces of the socket to flow around the edges (28) of the end press.

8. Method according to claim 7, wherein the material of the socket has a melting temperature lower than the softening temperature of the end press, and wherein the step of heating the socket comprises heating the socket to softening temperature of the socket, and the step of heating the end press comprises heating the end press to slightly above the melting temperature of the socket.

9. Method according to claim 7, wherein the material of the socket is a PFA-fluor-carbon plastic, the socket is heated to a temperature of between about 230° and 250° C., and the end press (16) is heated to a temperature of between about 350° and 400° C.

10. Method according to claim 7, wherein the step of heating the socket comprises providing a mold block (36) which is heatable and formed with an opening (38) matched approximately to the outer shape of the socket (24); heating the mold block to a temperature until the temperature of the socket (24) reaches said plastic deformation temperature;

providing a guide holder to hold the glass body (12) in alignment with the socket (24) in the recess (38) in the mold block, the guide structure being axially movable for introduction of the end press (16) of the glass body into the socket located in the opening of the mold block;

and the step of heating the end press comprises providing a heater to heat the end press (16) of the glass body before introduction thereof into the socket which has been heated to deformation temperature.

11. Method according to claim 8, wherein the end press is of essentially rectangular cross section, and the step of introducing the heated end press into the socket (24) includes flowing the melting material of the socket around the rectangular end press and to engage around the corners thereof and adjacent the longer side walls of the essentially rectangular end press.

12. Method according to claim 11, wherein the edges or corners of the end press are formed with slightly overlapping beads;

and the step of introducing the end press and flowing the material around the edges or corners comprises flowing said material around the overlapping beads to engage behind the overlapping portions thereof to grip along the surfaces of the corners or edges and interlock behind and beneath the overlapping bead of the end press.

13. Method according to claim 11, wherein the connecting electrical element (20) comprises a flexible lead;

said method including the step of electrically and mechanically attaching said flexible lead to the current conductor (18) prior to insertion of the heated end press (16) into the heat-deformable socket (24).

14. Method according to claim 13, wherein the end press is of generally rectangular cross section;

and wherein said step of heating the end press comprises directing a flame towards a longer side of the rectangular end press, while placing the pre-attached connecting lead (20, 22) at the side of the end press remote from the application of the flame to use the end press (16) as a heat shield for insulation (22) of said lead (20).

* * * * *